United States Patent [19]

Redding

[11] 4,022,131

[45] May 10, 1977

[54] ELECTRICALLY-OPERATED RELEASE APPARATUS

[76] Inventor: Robert J. Redding, September House, Cox Green Lane, Maidenhead, Berkshire, England, SL6 3EL

[22] Filed: Dec. 9, 1975

[21] Appl. No.: 639,059

[52] U.S. Cl. ..... 102/70.2 R; 361/251

[51] Int. Cl.[2] ..... F42B 5/08

[58] Field of Search ..... 102/70.2, 28; 317/79, 317/80

[56] References Cited

UNITED STATES PATENTS

| | | | |
|---|---|---|---|
| 2,869,364 | 1/1959 | Kabik et al. | 102/70.2 R |
| 3,225,695 | 12/1965 | Kapp et al. | 102/70.2 R |
| 3,703,867 | 11/1972 | Madlener et al. | 102/70.2 R |
| 3,880,082 | 4/1975 | Chernoff | 102/70.2 R |

*Primary Examiner*—Samuel Feinberg
*Attorney, Agent, or Firm*—James R. Cwayna

[57] ABSTRACT

A release apparatus, for example for releasing fire extinguishant, comprises an electrically-rupturable link such as, for example, an electrically-fired detonator; and a circuit responsive to a voltage applied to the apparatus to charge electrical energy storage means, such as a capacitor, while the applied voltage is in one state and at least partially to discharge the stored energy into the link to rupture the link when the applied voltage changes to another state, such as reversed polarity.

4 Claims, 2 Drawing Figures

ELECTRICALLY-OPERATED RELEASE APPARATUS

This invention relates to electrically-operated release apparatus, and particularly to apparatus for operating fire fighting equipment of the type in which an extinguishant is released automatically on receipt of a signal from a detector.

Such detector may be any known fire alarm device which senses heat, smoke or radiation as a means of warning of the onset of fire, and the extinguishant may be water or may be a gaseous or solid material, such as carbon dioxide or a halon.

Systems are known in which the detector operates a switch which causes a valve to open to release the extinguishant.

In oil refineries or chemical plants where there is a risk of ignition of the atmosphere by sparks or heat generated in normal or faulty operation of electrical circuits, all electrical circuits used must be made intrinsically safe, and my co-pending Pat. Application No. 37311/73 describes the intrinsically safe operation of a solenoid valve which may be employed, for example, for the release of extinguishant. However, both the valve itself and its electrical control circuit will only operate after a small time delay, and the valve provides only a small orifice for releasing the extinguishant.

It is desirable that the extinguishant shall be applied to the fire as quickly as possible, and a superior form of release device would be one employing a detonator to rupture the extinguishant container so that the contents are applied to the fire very rapidly.

It is an object of the present invention to provide a release apparatus which operates in an intrinsically safe manner.

According to the invention, the release apparatus comprises an electrically-rupturable link such as, for example, an electrically-fired detonator; and a circuit responsive to a voltage applied to the apparatus to charge electrical energy storage means, such as a capacitor, whilst the applied voltage is in one state and at least partially to discharge the stored energy into the link when the applied voltage changes to another state, such as reversed polarity.

Figure 1:
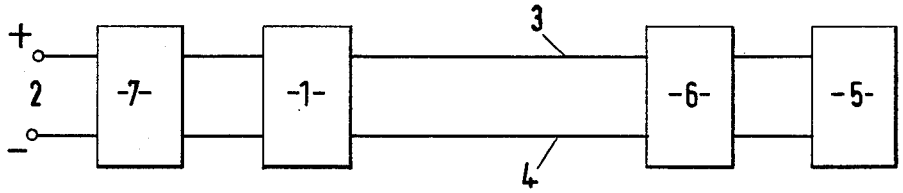
Figure 2:
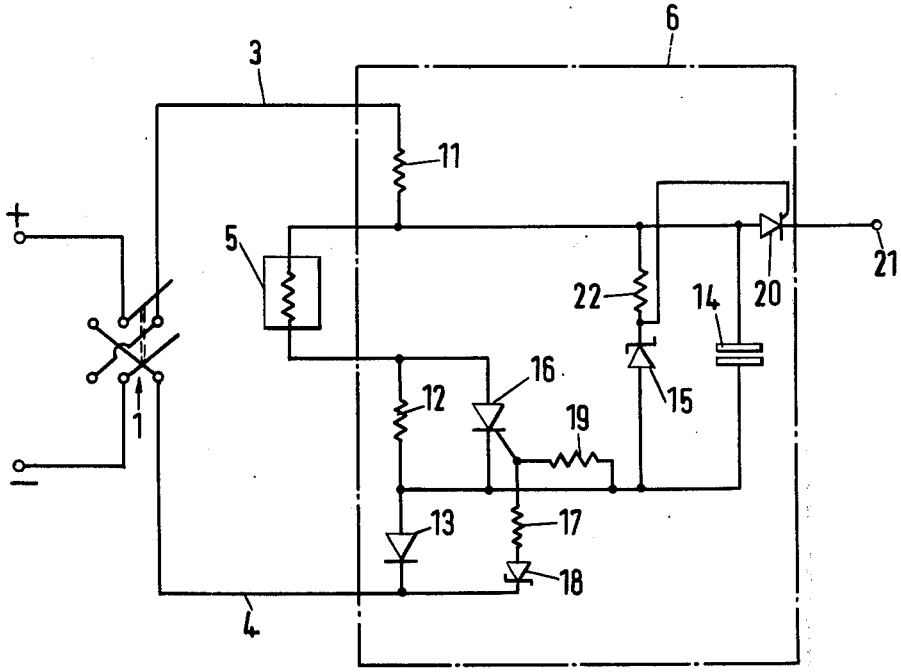

One embodiment of the invention will now be described, by way of example, with reference to the accompanying drawing, in which:

FIG. 1 is a block diagram of a fire extinguishing system incorporating a release apparatus in accordance with the present invention, and FIG. 2 is a circuit diagram of the apparatus.

Referring to FIG. 2, a fire extinguishing system comprises an initiating switch 1 fed from a d.c. supply 2 and connected by lines 3 and 4 to a detonator circuit connected to a detonator 5. The supply to the circuit 6 is made intrinsically safe by a Zener Safety Barrier 7 such as described in my patent specifications Nos. 977,913 and 1,310,354.

The circuit 6, the function of which is to make intrinsically safe operation practicable, is shown in detail in FIG. 2. The line 3 is connected to the detonator 5 via a current-limiting resistor 11, and the line 4 is connected to the detonator via a resistor 12 and a diode 13 connected in series. The resistance of the resistor 12 is several thousand times larger than the resistance of the detonator itself, so that normally only a small current flows through the detonator to prove that the circuit is intact.

A capacitor 14 of high capacitance and a zener diode 15 are connected in parallel with the series circuit comprising the detonator 5 and the resistor 12. The anode/cathode circuit of a thyristor 16 is connected in parallel with the resistor 12, and the gate electrode of the thyristor is connected, via a resistor 17 and a zener diode 18 in series, to the line 4. The gate electrode is also connected to the cathode of the thyristor via a resistor 19.

The switch 1 comprises a double-pole change-over switch for connecting the supply 2 to the circuit 6 with either polarity.

The operation of the circuit is as follows. When the switch 1 is set to connect the positive supply line to the line 3 and the negative supply line to the line 4, current flows through the resistor 11, the detonator 5, the resistor 12 and the diode 13. Since the resistor 12 is large, the current is insufficient to fire the detonator. Most of the voltage appears across the resistor 12, and hence across the series circuit comprising the resistor 12 and the detonator 5. The capacitor 14 is charged by this voltage until the voltage across the zener diode 15 causes the diode to conduct at a value a few volts below the minimum value applied to the lines 3 and 4. The circuit then remains in a quiescent state with the capacitor charged.

Reversing the switch 1 causes the diode 13 to become non-conductive, and the supply voltage therefore appears across this diode. This voltage is in series with the voltage across the capacitor 14. The diode 18 therefore conducts, and a triggering signal is applied to the gate of the thyristor 16. The thyristor therefore conducts and discharges the capacitor 14 through the detonator 5. The detonator explodes and thereby ruptures the extinguishant container (not shown), thereby releasing the extinguishant.

The resistor 19 (or other suitable component) can be optionally connected, as shown, between the gate and the cathode of the thyristor for stability and to provide a discharge path for any space charge within the thyristor.

All of the components in the circuit 6, and if desired also the detonator 5, can be encapsulated in a resin or other permanent material to enhance the reliability and to ensure the safety of the assembly in a hazardous location. The assembly can then have only two terminals for connection of the lines 3 and 4. The circuit will appear non-reactive at the lines 3 and 4.

The system described is very reliable in that a constant predetermined quantity of energy is available for firing the detonator. Furthermore, the system is self checking and will not fire if a fault occurs in the cabling. The detonator will only be fired if the voltage applied to the lines 3 and 4 is reversed without open-circuiting the supply for more than a fraction of a second.

By suitable choice of the zener diodes 15 and 18, or by use of additional logic, the circuitry could be arranged to compare the voltage across the diode 15 and the voltage across the diode 13. Alternatively, more stringent tests on the applied supply voltage can be performed in order to ensure that the detonator does not fire unintentionally due to line faults or due to picking up of transients and spurious voltages in the connecting circuits. A further advantage is that by suitable choice of the resistor 11 the current in the quiescent state may be made quite small, e.g. 1 mA, but still sufficient to provide a check that the circuit is in order. In view of the low quiescent current level, a number of detonators may be fed in parallel from a single intrinsically safe source. These detonators may all be fired simultaneously by a single switch, such as the switch 1. Alternatively, the firing of a plurality of detonators by separate respective firing circuits may be controlled by a single switch. Capacitors 14 of different capacitance values may then be used in the respective firing circuits so that the detonators fire in rapid succession, the time taken for the detonator to fire being dependent upon the capacitance.

Although described above in the context of firing electrical detonators, the apparatus of the present invention is also applicable to other devices in which a burst of electrical energy causes mechanical rupturing, for example the blowing of an electrical fuse to interrupt a circuit, or releasing of stored mechanical energy as in a trigger mechanism.

The firing circuit 6 of the detonator is intrinsically safe because the diode 13 prevents the energy that is stored in the capacitor 14 from passing back to the lines 3 and 4. Provision can be made, if required, for indicating that the capacitor is fully charged. One way to achieve this is to provide a test terminal 21 which becomes live when the circuit is in order. This may be achieved by connecting a thyristor or controlled rectifier 20 between one of the terminals of the capacitor 14 and the test terminal 21 which is external to the encapsulation. A resistor 22, connected in series with the zener diode 15, will provide a voltage drop when the capacitor 14 is fully charged, and this voltage drop is applied to the thyristor 20 in order to turn it on. Thus, if the power supply to the lines 3 and 4 is interrupted, or the detonator 5 fails, or the lines 3 and 4 become short-circuited, the zener diode 15 and the thyristor 20 will not conduct and the lack of a potential at the terminal 21 can initiate an alarm.

When more than one detonator is required to operate simultaneously, the second and subsequent ones can have their resistors 11 connected to the test terminal 21 of the previous unit (instead of to the line 3) so that a voltage appearing at the terminal 21 of the final unit 6 shows that all the units are in order.

By electrically detecting the magnitude of the reverse current within the encapsulated detonator assembly when the switch 1 is reversed, and ensuring that the current is of the appropriate order related to the previous charging voltage, we can ensure that the circuit is not triggered by pulses or induced surges which might appear in the lines. The detection can employ well known circuitry to check not only the voltage applied and its polarity but the rate of change of the supplied current, since this is influenced by the inductance and capacitance of lines 3 and 4. In this way the detector is made to respond only to the change in polarity of one particular voltage source at a specific point in the circuit and to disregard any voltage injected at all other points.

The electrical energy storage means may be of any suitable type in place of the capacitor 14. For example, the storage means may comprise an electrolytic cell or a secondary cell of the nickel-cadmium type.

I claim:

1. A release apparatus comprising an electrically rupturable link; electrical energy storage means; and a circuit operative, in response to a voltage applied thereto, to charge the storage means whilst the applied voltage is in a first polarity condition and at least partially to discharge the stored energy into the link to rupture the link when the applied voltage changes to a polarity condition opposite of said first polarity condition.

2. Apparatus as claimed in claim 1 and said rupturable link being arranged and constructed to control a fire extinguishing system for the immediate release of an extinguishing medium upon rupture of said link.

3. A release apparatus comprising an electrically rupturable link; electrical energy storage means; and a circuit operative, in response to a voltage applied thereto, to charge the storage means whilst the applied voltage is in one predetermined state and at least partially to discharge the stored energy into the link to rupture the link when the applied voltage changes to another predetermined state and means to apply an indicating signal to a test point when said storage means is charged, said means including a series circuit comprising resistive means in series with a zener diode, the series circuit being connected in parallel with said storage means, said zener diode allowing current flow through the resistive means only when the voltage across the energy storage means attains a predetermined level, the resultant voltage drop across said resistive means causing application of the indicating signal to said test point.

4. Apparatus as claimed in claim 3 including a controlled rectifier connected between said test point and one terminal point of said storage means, said voltage drop acting as a firing signal for said further controlled rectifier.

* * * * *